US005775486A

United States Patent [19]

Edqvist

[11] Patent Number: 5,775,486

[45] Date of Patent: Jul. 7, 1998

[54] PACKAGE AND METHOD FOR PRODUCING SAID PACKAGE

[76] Inventor: Håkan Edqvist, Mosstorpsvägen 40, S-617 00 Skärblacka, Sweden

[21] Appl. No.: 932,395

[22] Filed: Sep. 17, 1997

Related U.S. Application Data

[63] Continuation of Ser. No. 605,079, Mar. 1, 1996, filed as PCT/SE94/00784, published as WO95/06604, abandoned.

[30] Foreign Application Priority Data

Sep. 1, 1993 [SE] Sweden ..... 9302822-3

[51] Int. Cl.[6] ..... B65D 75/00

[52] U.S. Cl. ..... 206/145; 206/147; 206/161; 206/427; 53/399

[58] Field of Search ..... 206/139, 144, 206/145, 147, 151–154, 158, 460, 160–161, 192, 427, 432–433; 53/399

[56] References Cited

U.S. PATENT DOCUMENTS 4,523,676 6/1985 Barrash .

FOREIGN PATENT DOCUMENTS 0454450 10/1991 European Pat. Off. .
3711766 10/1988 Germany .
3739574 6/1989 Germany .

*Primary Examiner*—Paul T. Sewell
*Assistant Examiner*—Nhan T. Lam
*Attorney, Agent, or Firm*—Ostrolenk, Faber, Gerb & Soffen, LLP

[57] ABSTRACT

To prevent honeycombing of containers of adjacent multi-packs each having a container positioning top-carrier and which are combined together by means of a strapping band, cardboard or other material is placed between the juxtaposed surfaces of the cylindrical containers in each group before the strapping band is applied. Good package stability and minimal waste result.

13 Claims, 6 Drawing Sheets

PACKAGE AND METHOD FOR PRODUCING SAID PACKAGE

This is a Continuation of application Ser. No. 08/605,079 filed on Mar. 1, 1996, filed as PCT/SE94/00784 published as WO95/06604, abandoned.

FIELD OF THE INVENTION

The invention relates to a package for a plurality of containers in row type multipacks which are supported and banded together to inhibit honeycombing of the package of containers and to a method for producing such a package.

BACKGROUND TO THE INVENTION

In today's packaging industry, foodstuffs and other articles in bottles, jars, pots, tins and other cylindrical walled containers are often distributed using cardboard boxes or containers with or without the addition of plastic films (e.g. shrink-wrapping). In an effort to reduce the amount of cardboard/plastics required and thus the packaging waste, certain packaging combinations have a simple, folded outer layer of corrugated cardboard which acts as a support base for a plurality of containers and as a lateral support by means of its sides. A tensioned strapping band may also be stretched around the cardboard and container group to provide more stability.

Whilst such packaging offers a partial solution to low wastage, the solution is designed for individual containers which will be separated after removal of the band, e.g. for filling shelves of a supermarket. Thus, the cardboard packaging which supports the containers will have to be removed and thrown away in the supermarket.

Additionally, such packs which have more than two rows of containers are formed generally using a honeycomb formation of containers, since the forces acting on the containers due to the tensioned strapping band will make the containers adopt this formation. The disadvantage with such a formation is however that the pack will have "dead" corner and/or end portions which take up a large amount of storage space, which is of importance especially on shop shelves. Even those packages which are originally formed from a plurality of containers arranged in rectangular groups (i.e. not honeycombed) can have the problem that the containers will tend to assume their natural position and will tend to honeycomb during transport. This can lead to instability and the promotion of relative vertical movement on lifting the packages which may lead to package collapse.

A further requirement which must be met, in order to increase sales and to provide a convenient handling means, is the supply of containers as a multi-pack, i.e. containing two or more packs held together, e.g. by a cardboard carrier, after the removal of the unsightly strapping band. An example of such a multi-pack carrier is shown in EP-A-496 807 for example, the subject matter of which is incorporated herewith by reference.

The object of the present invention is thus to provide a solution for strapping together multi-packs of containers (i.e. rows or packs which each comprise a plurality of containers held together at their upper ends normally by a cardboard carrier) in such a way which prevents honeycombing and which results in a minimum of waste.

A previous attempt at solving the problem of containers sliding against each other and thus to avoid inter-container damage is known from DE-A-3 739 574. This discloses a U-shaped cardboard piece which is positioned around the bottom of two containers of a single consumer six-pack held together with a strapping band. Whilst the containers are better protected by the intermediate cardboard the problem of honeycombing is not in fact prevented and the tensioned strapping band can easily loosen and result in package collapse with consequent container damage. Also, the package is severely limited in its application since the U-shaped piece must surround a middle row, requiring thus always an uneven number of rows and a large functionless cardboard U-piece, which must be thrown away as soon as the strapping band is broken.

SUMMARY OF THE INVENTION

The above object is solved by a package and a method having the following elements.

The package is comprised of a plurality of containers arranged in a plurality of multiple container packs. Each container has a curved outer wall surface, so that the containers would normally shift and honeycomb in positions when banded tightly together. Instead, respective pluralities of the containers are united in multipacks, particularly single row multipacks, by respective folded blanks that are attached at the top and upper part of each container. Each folded blank individually engages each of the containers in the respective multirow pack for prohibiting movement in position of each container with reference to the other containers in the one pack.

A plurality of at least two of the multipacks are banded together by a tensioned encircling band wrapped around all of the multipacks. Toward the upper part of the container, means that prevent relative slippage of adjacent opposing containers in adjacent multipacks which would contact each other extend between the curved surfaces of the upper parts of the containers in one multipack and the upper parts of the adjacent opposing containers in the adjacent multipack, while the lower parts of the adjacent opposing containers in adjacent multipacks may contact each other directly. Those means may comprise cardboard inserts or flaps from the folded blanks.

The method of producing such a package comprises assembling individual multipacks with the respective folded blank over the tops of the container for defining each multipack and then arranging adjacent multipacks with means that prevents relative movement of the adjacent opposing containers of adjacent multipacks, and then banding the containers together to define the package.

With the individual multi-packs (i.e. with top carrier/top uniting element which holds each of the containers firmly at the upper end) arranged adjacent one another and by adopting the addition of an amount of intermediate material between the containers' juxtaposed surfaces, the honeycombing effect can be substantially eliminated when a strapping band is applied.

BRIEF DESCRIPTION OF THE FIGURE

The invention will now be described in more detail with reference to certain embodiments and the accompanying drawings, in which.

DETAILED DESCRIPTION OF A PREFERRED EMBODIMENT

Figure 1:
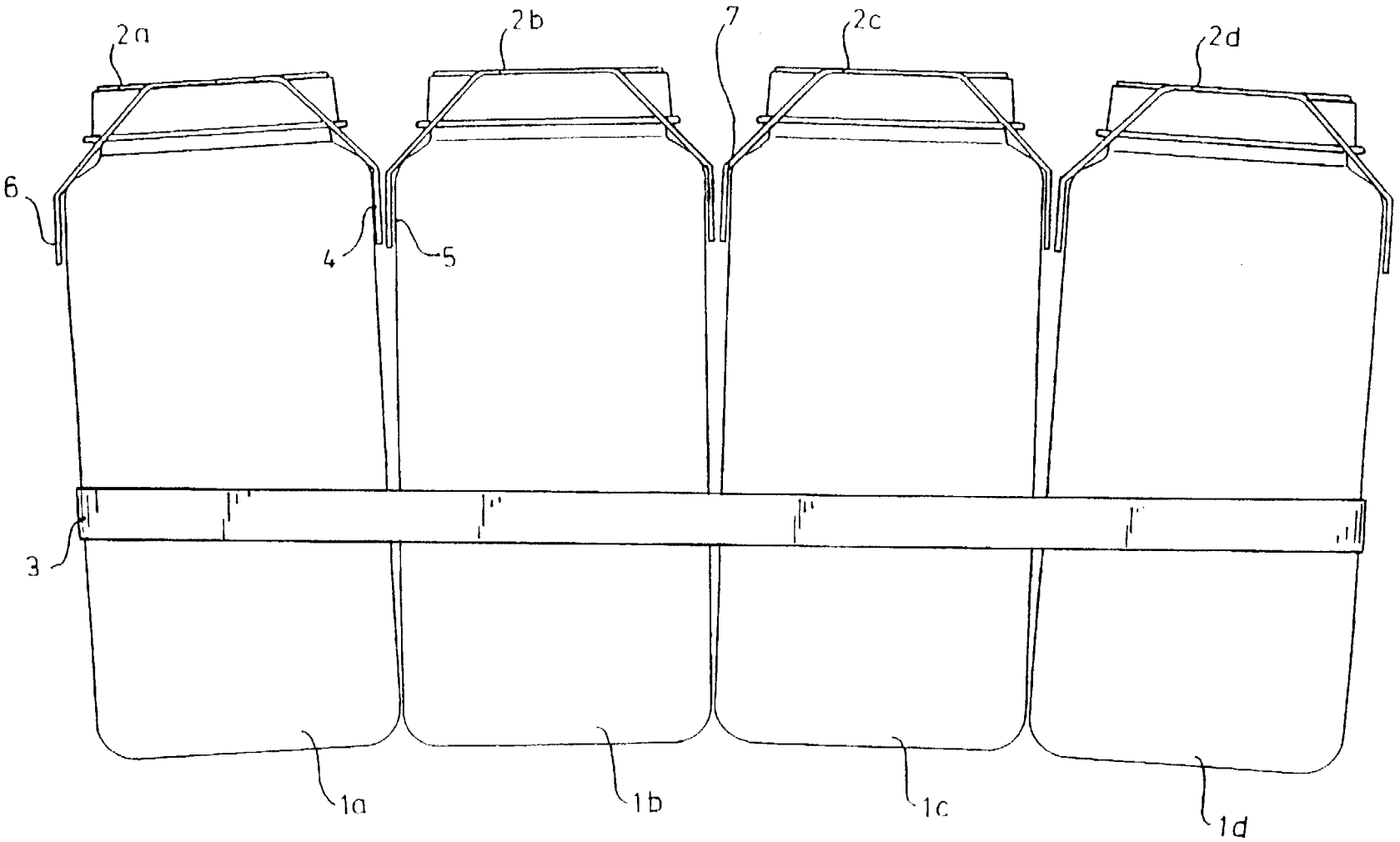
FIG. 1 shows a side view of four individual multi-packs joined together by a single strapping band.
Figure 2:
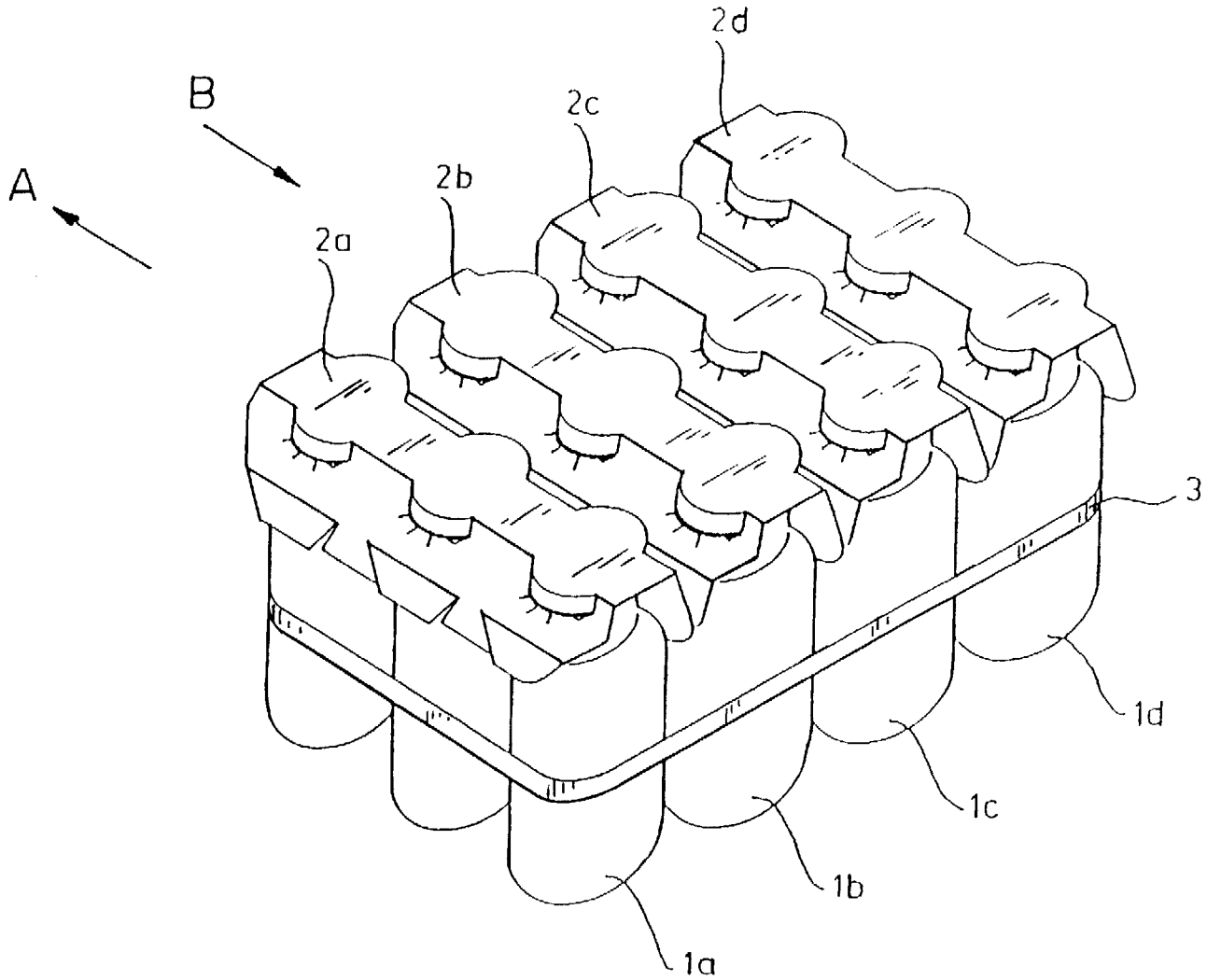
FIG. 2 shows a perspective view of four individual multi packs, similar to those of FIG. 1, joined together as in FIG. 1, FIG. 3 and FIG. 4 show respective side and perspective views of two multi-packs containing six containers per pack.

The package shown in FIG. 1 and FIG. 2 comprises twelve containers 1*a–d* arranged in four rows. The first row has three cans 1*a*, the second row has three cans 1*b* etc. Each row of containers is thus joined in a multi-pack of three containers by means of a folded cardboard carrier blank 2*a–*2*d* respectively. As seen in FIGS. 1 and 2 (as well as the alternate embodiments of FIGS. 4 and 5), each respective folded blank 2*a–*2*d* wraps is secured on the top end of the respective containers in its pack, that is the respective row of three containers in FIG. 2. Hence, the cardboard blank assembles and defines each multipack. Whilst three containers are shown, any number of containers greater than one may be used with the invention, e.g. two containers in each multi-pack row. Similarly, many rows of multi-packs are possible (e.g. four rows of 2-packs or four rows of 3-packs etc.) or a multi-pack having packs arranged in two or more rows joined by one folded carrier element, or two carrier elements joined by adhesive so as to form a larger single joined multi-pack.

A single strapping band 3, suitably of polypropylene, is tensioned around the four rows of containers to hold them together. The forces in the strapping band in its fixed state and the forces arising during its method of application during strapping would normally force the four rows to adopt a honeycomb formation as discussed above. However, to avoid this, the invention provides means for preventing the sideways movement of one pack with respect to the next, without adding significant amounts of extra material.

One or both of the flaps 4 and 5 on the sides of the containers facing each other may be longer than the flaps 6 and 7 on the outer sides. The juxtaposed flaps 4 and 5 thus extend down into the region of contact of the cylindrical containers of each row. In this way, due to the presence of the cardboard between juxtaposed containers, the frictional resistance to movement between said containers after application of the tensioned strapping band will normally be high enough to prevent side slip of one multi-pack container group with respect to the other (i.e. one in direction A, the other in direction B) due to the combined presence of the band, the frictional contact of the cardboard and the connection of the cans by the multi-pack carrier. The actual extent of the cardboard required between the two rows of containers is something which can be arrived at by experimentation and depends on the type and weight of container, the thickness of cardboard etc.

A suitable dimension for the strapping band would normally be up to about 50 mm, although larger dimensions could be used. Even with such narrow bands (50 mm or under) the invention still provides a honeycomb-preventing solution.

Figure 3:
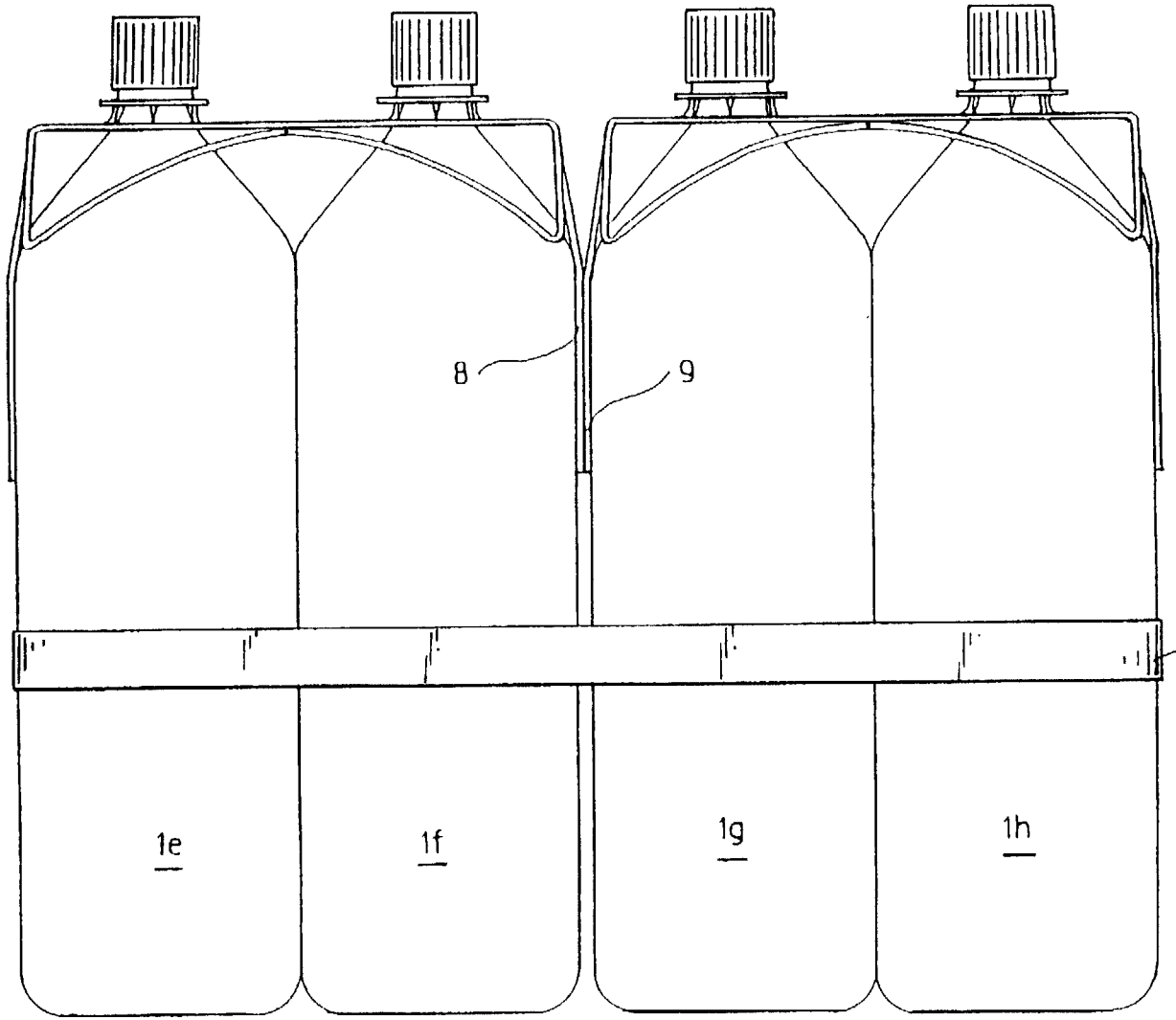
Figure 6:
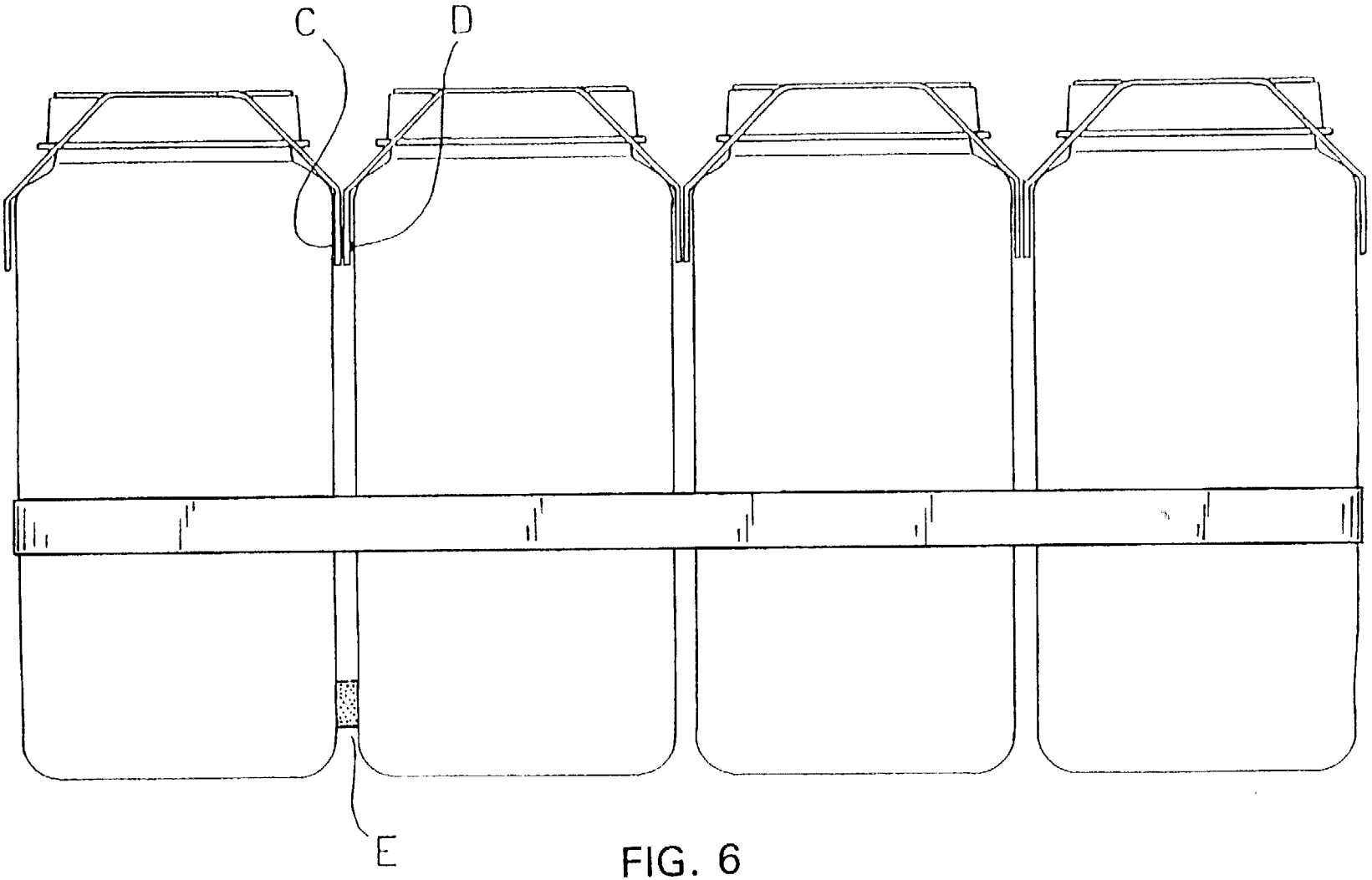
FIG. 6 shows the arrangement of FIG. 1 with various possible alternative adhesive locations marked thereon.

FIG. 1 shows that there is no gap between the containers at their lower ends, since the tensioned band 3 will bunch the cans together. Indeed, a small angle is formed between the containers in adjacent multipacks. For simplicity, FIGS. 3 and 6 show a gap between the containers at their lower ends, although in reality the gap does not exist. Similarly, whilst the cardboard flaps 4 and 5 are not shown as being in contact with one another, they will be since the band 3 is under tension.

As a second embodiment of the invention (not shown), the cardboard provided by flaps 4 and 5 (as denoted in FIGS. 1 to 4 and 6) between the containers can be separate from the carrier elements 2*a–d*. Thus, a separate strip or separate strips of cardboard could be inserted between the adjacent rows of multi-packs instead of these strips being joined to the carriers 2*a–*2*d*. In an adaptation of this, the insert does not necessarily have to be between all the containers, but only some, although being between all containers would be the most preferred solution from many aspects. The important feature to be achieved is the adequate amount of frictional resistance between the containers at this particular location.

Figure 4:
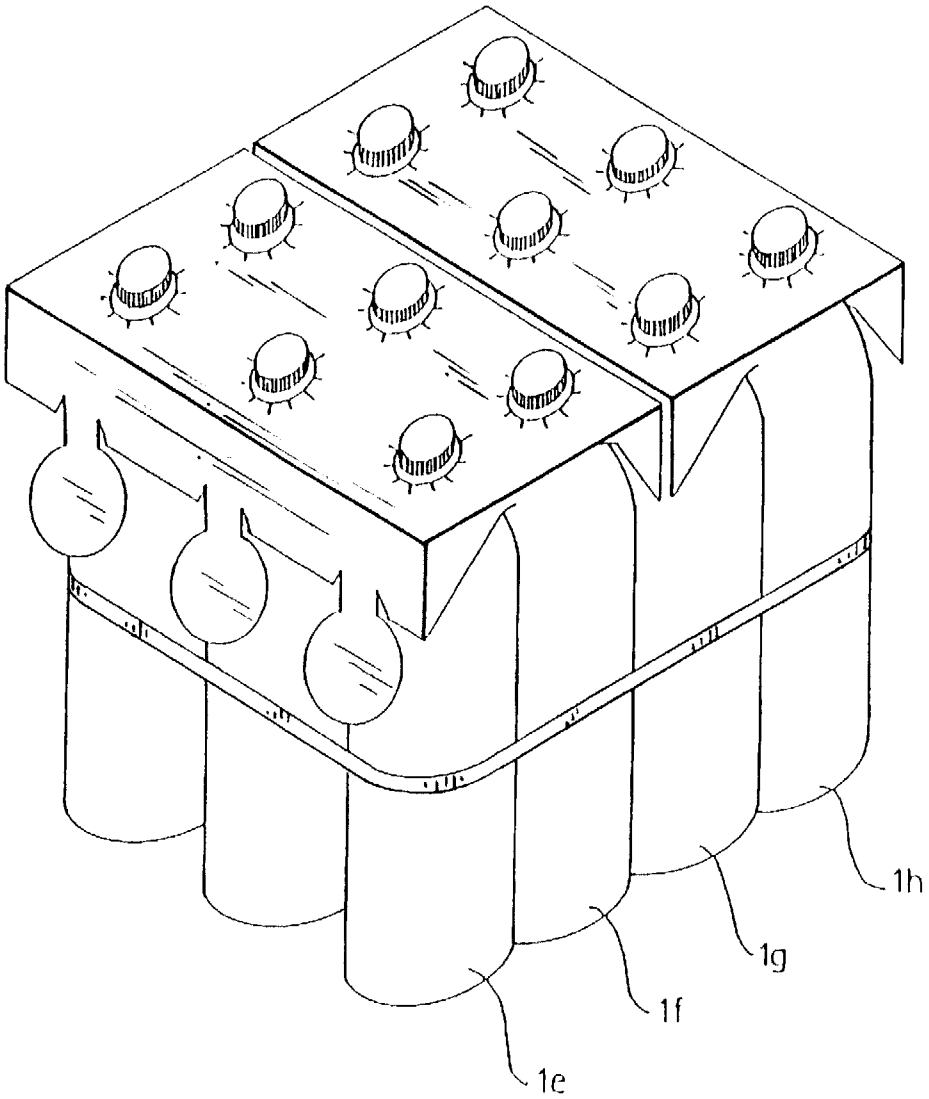

FIGS. 3 and 4 show respective side and perspective views of two multi-packs each having two rows of three containers 1*e* and 1*f* (or 1*g* and 1*h*) per multi-pack, said multi-packs being joined together by means of the tensioned band 3 with the flaps 8 and 9 in compressed contact. In this case also the figure is only a schematic representation and the container rows 1*f* and 1*g* would of course normally be in contact at least at their lower ends.

A third embodiment of the invention is, instead of any cardboard insert or extension between the containers, to use a small area of suitable adhesive, e.g. hot melt, between the containers of each row in order to obtain the required effect. However it is also possible that the adhesive could be used in addition to said cardboard. When adhesive and cardboard are used in combination, a suitable placement of the adhesive is between the container cylindrical surface and the cardboard flap which fixes the containers positionally with respect to each other. In such a case, the additional advantages are obtained that the consumer pack (i.e. each of the multi-packs) provides its own tamper-evident/tamper-preventing seal whilst at the same time preventing rotation of each of the containers (which leads to improved package appearance).

Alternatively adhesive may be placed at any other suitable location between the cylindrical surfaces of adjacent cans or adjacent multi-packs. The various alternative locations for the adhesive will be outlined with reference to FIG. 6.

The adhesive should be such that the strength and adhesion in the longitudinal shear direction (i.e. direction A/B) should be significant whilst the strength in a lateral direction should be relatively insignificant so as to allow consumers to easily separate the multi-packs from each other or cans from their upper cardboard carrier when desired, yet still prevent sideways slipping.

In order to prevent honeycombing of the containers during packaging together using the band 3, the package according to the invention should be assembled as follows. When using cardboard or the like as the frictional resistance producer between the containers, the cardboard will be unable to produce any resistance effect until the band 3 becomes taut. Thus, when the multi-packs have been positioned side-by-side ready for banding together, a frame member or other movement-preventing member (e.g. on the banding machine) must be used to prevent relative movement of the packages during the banding operation.

When an adhesive is used as the means for preventing honeycombing, no frame member is required on the banding machine since the adhesive is able to perform this function as well. However, depending on the forces applied during banding it may be convenient to also use a frame member in this case also.

A fourth embodiment is also possible, where shock absorbing properties (as described later) might be required.

In this embodiment the banding function and the shock absorbing properties can be provided in one complete cardboard strip which can be supplied in rolls. The cardboard band is merely tensioned around s-he cylindrical containers and the ends glued together (or otherwise suitably joined). Where a purely cardboard solution is used (i.e. no plastic band or adhesive) significant recycling advantages are obtained.

Figure 5:
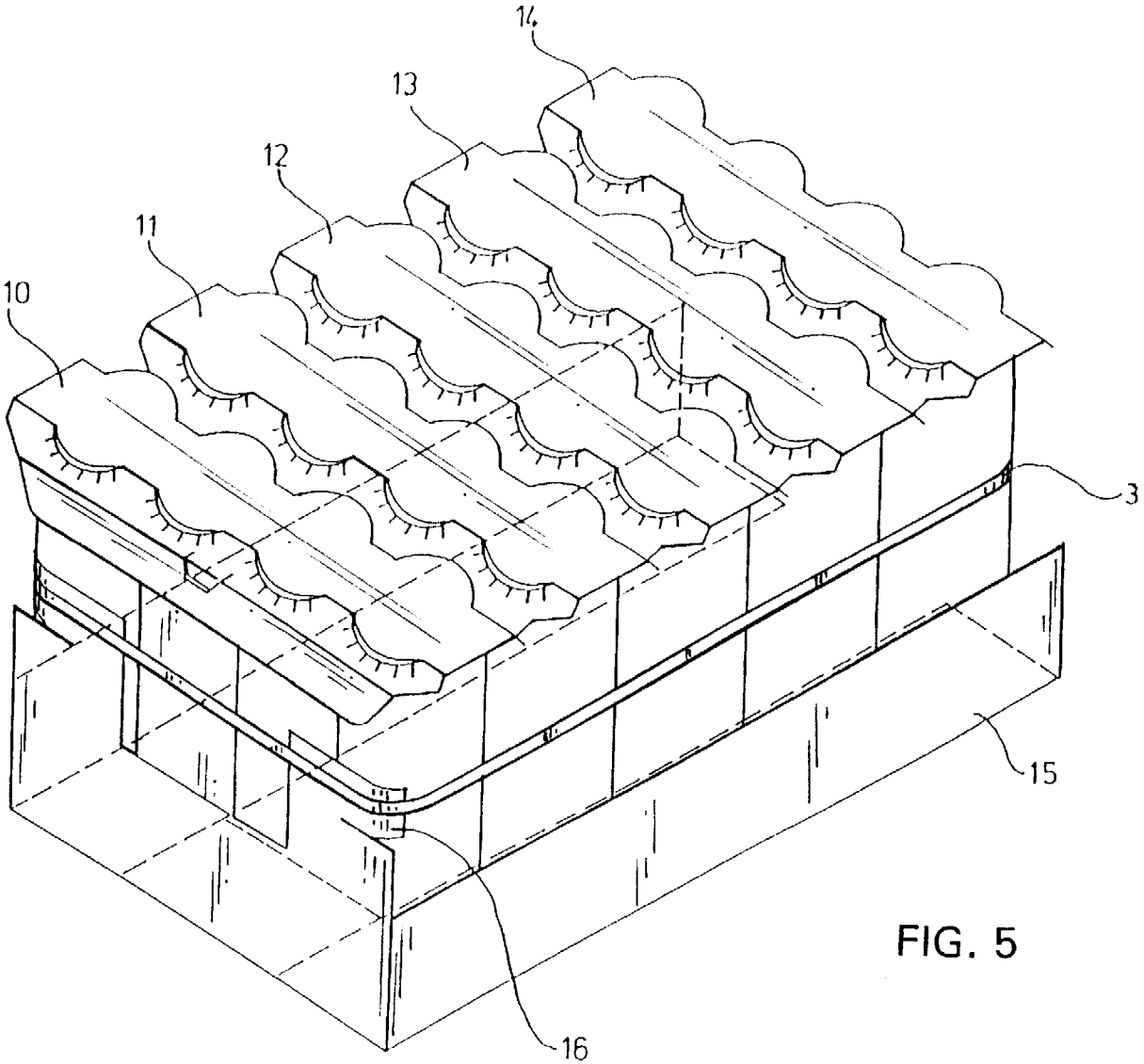
FIG. 5 shows a view of five multi-packs containing four containers per pack.

A further embodiment as shown in FIG. 5 involves the use of a shock absorbing protective layer for the containers (such as if the retailer requires glass containers to be especially protected). In such a case, additional shock absorbing material 15 may be used which, in the shown example is in the form of an open ended (at one end) underlay to protect the lower and most vulnerable surfaces of the containers from damage (e.g. with glass containers). The underlay for the five multi packs 10–14 is held in position in the shown embodiment by the band 3 which is fastened around two extended portions 16 of the underlay. Also in this embodiment the band 3 may be made shock-absorbing if this is required.

Since no cardboard extends down between the contacting container surfaces of each row, either separate strips must be used or adhesive (not shown) as previously described between e.g. the lower ends of the containers.

FIG. 6 is a similar view to that of FIG. 1, although adhesive (suitably hot-melt adhesive) is shown as applied in various alternative locations. In some cases a combination of certain locations could obviously be used however. Locations C, D, and E are shown as schematic representations of possible glue locations and thus the glue thickness at these locations can obviously vary within large limits.

Location C shows, for example glue which is placed between the cardboard flaps of adjacent rows of containers. The glue of course, as in accordance with that aforementioned, has the purpose of obtaining a shear force resistance, but must naturally be weak in the direction which allows the rows to be separated from one another. A further application of this could be where it is desired to form a combined multi-pack between two or more rows such that the individual carrier elements would be attached together as a single pack.

Location D is between the cardboard flap and the container itself, thus providing the particular advantage of a tamper-evident connection.

Location E is between the adjacent cylindrical surfaces of the containers and serves not only to provide the required shear resistance at this location, but also provides a damage protection barrier between containers. Clearly the distance from the bottom of the containers of this glue location is not of the utmost importance, but it should be below the strapping band 3 for the best results when adhesive is indeed used.

The packages which result from the invention are thus readily stackable with further packaging units on a pallet. A further strapping band may then be placed around one or several of the complete pallet layers if increased stability is required (e.g. for transport). For shelf stacking in a supermarket or the like, the package merely needs to be put into the shelf, before or after severing the strapping bands. As will be apparent, all the available shelf space can then be used to best effect by appropriate stacking of the individual multi-packs which are ready for consumer purchase.

Thus without requiring any type of under-tray support for the containers, a stable and economic package has been produced which involves particularly low wastage. This is a particular advantage compared to the previously known container packages mentioned in the introduction since the only cardboard (or similar) which need be present with this invention is that having a specific after-purchase consumer function as a functional carrier (i.e. as a multi-pack carrier) whilst at the same time providing, in combination with the strapping band, good stability.

The packaging idea of the invention may also be extended further to the joining together of multi-packs of containers each of which is in itself a honeycomb formation of containers (by virtue of the carrier element itself providing such an arrangement). This would be achieved by the containers in adjacent outer rows of each multi-pack being placed in a juxtaposed relationship (i.e. non-honeycombed with respect to each other) and friction enhancing material being placed between the containers of the multi-packs, said material either being part of and/or separate from the top carrier elements. In this way a more stable grouping is obtained.

In certain cases with e.g. glass containers, it may be desirable to improve the shock absorbing properties of the outer sides of the package. This can be achieved simply with this invention by making the strapping band with a combined shock absorbing layer (e.g. hot melt outer layer on the band) which will also help to increase the frictional resistance of the strapping band to the containers.

The invention is not limited to the embodiments described above but may be varied to a large extent within the scope of the claims appended hereto. In particular, the choice of materials, the size of the cardboard inserts or adhesive zones as well as the strapping band tension and location may all be varied depending on the type of container multi-packs in question. For example, long containers in a large multi-pack will require more frictional resistance to be achieved than those of a small group with small containers and a solution to this may be larger strips of cardboard for example.

I claim:

1. A package comprising:

a plurality of containers wherein each container has a curved outer wall surface, a top region, an upper part at and below the top region and a lower part toward the bottom of the container; the containers being assemblable into a plurality of multipacks and each multipack being comprised of a plurality of containers arranged in at least one row of containers;

a respective folded blank for each multipack, the blank being comprised of a foldable material including respective regions on the blank shaped for engaging and holding the top region of the containers in the respective multipack and for maintaining the relative positions in the multipack of each of the containers thereof;

at least two of the multipacks being placed adjacent to one another, respective adjacent containers of the adjacent multipacks being positioned to be opposed to one another and to be in engagement on their respective opposing outwardly facing sides;

a tensioned band encircling the multipacks for drawing the multipacks together to form the package, such that the band draws the lower parts of opposing adjacent containers of adjacent multipacks into engagement;

means for resisting slippage of the opposing adjacent containers in the adjacent multipacks, the means being formed of a material which resists such slippage and being disposed between the upper parts of the opposing adjacent containers of adjacent multipacks and extending a short distance toward the lower parts of the containers such that a small angle is formed between opposing adjacent containers of adjacent multipacks of the package.

2. The package of claim 1, wherein the folded blanks are comprised of cardboard.

3. The package of claim 1, wherein the means disposed between the upper parts of opposing adjacent containers in adjacent multipacks comprise cardboard.

4. The package of claim 1, wherein the means disposed between the upper parts of adjacent opposing containers in adjacent multipacks comprise flaps attached on the folded blanks which extend down between the opposing adjacent containers.

5. The package of claim 4, wherein the blanks and the flaps thereof are comprised of cardboard.

6. The package of claim 4, further comprising an area of adhesive placed on the lower parts of opposing adjacent containers in adjacent multipacks; and an additional area of adhesive applied between the containers and the flaps adjacent the containers.

7. The package of claim 4, further comprising an area of adhesive applied between the respective flaps of adjacent multipacks wherein the flaps pass each other to form a package including the two multipacks adhered together.

8. The package of claim 1, further comprising an area of adhesive placed on the lower parts of adjacent multipacks.

9. The package of claim 8, wherein the adhesive is a hot melt adhesive.

10. The package of claim 8, wherein the means comprise integrally formed extensions of the blanks.

11. The method of claim 10, further comprising applying an adhesive between the adjacent opposing containers of adjacent multipacks.

12. The method of claim 11, wherein the adhesive is applied toward the lower parts of the containers while the movement preventing means is located toward the upper parts of the containers.

13. A method of producing a package comprised of several multipacks of containers, the method comprising:

securing a respective plurality of the containers in a folded blank that is shaped for engaging and holding each of the containers in position with respect to each other by installing the blank over tops of the containers to hold the containers in position to form a multipack;

positioning between containers in adjacent multipacks means for preventing relative movement between adjacent opposing containers of two adjacent multipacks which are to be assembled together to form the package;

with the means for preventing relative motion between the containers in position, banding the multipacks together with an elastic band which draws the multipacks together so that the opposing adjacent containers of the adjacent multipacks are brought into engagement, with the upper parts of the containers engaging the relative movement preventing means and the lower parts of the containers engaging each other, whereby the means for preventing movement prevents containers in adjacent multipacks from shifting with respect to each other during the banding together of the multipacks and while they are banded together.

* * * * *